US010072313B2

(12) United States Patent
Takahashi et al.

(10) Patent No.: US 10,072,313 B2
(45) Date of Patent: Sep. 11, 2018

(54) METHOD FOR SMELTING NICKEL OXIDE ORE

(71) Applicant: SUMITOMO METAL MINING CO., LTD., Tokyo (JP)

(72) Inventors: Junichi Takahashi, Tokyo (JP); Taku Inoue, Tokyo (JP); Shuuji Okada, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 15/537,965

(22) PCT Filed: Sep. 15, 2015

(86) PCT No.: PCT/JP2015/076198

§ 371 (c)(1),
(2) Date: Jun. 20, 2017

(87) PCT Pub. No.: WO2016/103812

PCT Pub. Date: Jun. 30, 2016

(65) Prior Publication Data

US 2017/0342514 A1 Nov. 30, 2017

(30) Foreign Application Priority Data

Dec. 24, 2014 (JP) ..... 2014-260759

(51) Int. Cl.
*C21B 13/10* (2006.01)
*C22B 1/24* (2006.01)
(Continued)

(52) U.S. Cl.
CPC ..... *C21B 13/10* (2013.01); *C21B 13/08* (2013.01); *C22B 1/2406* (2013.01); *C22B 5/10* (2013.01); *C22B 23/021* (2013.01)

(58) Field of Classification Search
None
See application file for complete search history.

(56) References Cited

U.S. PATENT DOCUMENTS 3,849,113 A * 11/1974 Ban ..... C22B 23/023 75/10.39
3,854,936 A 12/1974 Hunter et al.
(Continued)

FOREIGN PATENT DOCUMENTS

CA 958221 A 11/1974
CA 1332286 C 10/1994
(Continued)

OTHER PUBLICATIONS

Notice of Reasons for Rejection dated Mar. 29, 2016, issued to JP Application No. 2014-260759 and English machine translation thereof.

(Continued)

*Primary Examiner* — George Wyszomierski
(74) *Attorney, Agent, or Firm* — Locke Lord LLP; James E. Armstrong, IV; Nicholas J. DiCeglie, Jr.

(57) ABSTRACT

Provided is a smelting method capable of effectively promoting a reduction reaction on pellets formed using nickel oxide ore as starting material to obtain a ferronickel alloy with a high nickel grade of at least 4%. The present invention is a method for smelting nickel oxide ore wherein ferronickel alloy with a nickel grade of at least 4%, the method comprising a pellet-producing step S1 for producing pellets from nickel oxide ore, and a reducing step S2 for reduction-heating of the obtained pellets in a smelting furnace. In the pellet-producing step S1, the pellets are produced by mixing nickel oxide ore with a specified amount of a carbonaceous reducing agent as starting materials. In the reducing step S2, the produced pellets are charged in a smelting furnace in which a carbonaceous (Continued)

reducing agent (furnace bottom carbonaceous reducing agent) has been spread over the entire furnace bottom and reduction-heating is performed.

2 Claims, 5 Drawing Sheets

(51) Int. Cl.

| | |
|---|---|
| ***C22B 5/10*** | (2006.01) |
| ***C22B 23/02*** | (2006.01) |
| ***C21B 13/08*** | (2006.01) |

(56) References Cited

U.S. PATENT DOCUMENTS

| | | | | |
|---|---|---|---|---|
| 4,049,444 | A | 9/1977 | Bell et al. | |
| 4,195,986 | A | 4/1980 | Schulz et al. | |
| 4,490,169 | A * | 12/1984 | Persson | H05B 7/20 420/428 |
| 4,701,217 | A | 10/1987 | Warner | |
| 5,178,666 | A | 1/1993 | Diaz et al. | |
| 9,752,210 | B2 | 9/2017 | Takahashi et al. | |
| 2005/0211020 | A1 | 9/2005 | Sugitatsu et al. | |
| 2013/0074654 | A1 | 3/2013 | Ito | |
| 2015/0292055 | A1 * | 10/2015 | Tsushima | C22B 7/02 75/765 |
| 2017/0342514 | A1 | 11/2017 | Takahashi et al. | |

FOREIGN PATENT DOCUMENTS

| | | | |
|---|---|---|---|
| CN | 101020957 | A | 8/2007 |
| CN | 101392330 | A | 3/2009 |
| CN | 101481753 | A | 7/2009 |
| CN | 102643976 | A | 8/2012 |
| EP | 1167547 | A1 | 1/2002 |
| EP | 2226403 | A1 | 9/2010 |
| JP | S50-105506 | A | 8/1975 |
| JP | 01-021855 | B2 | 4/1989 |
| JP | H05-311265 | A | 11/1993 |
| JP | 06-025770 | A | 2/1994 |
| JP | 2001-181720 | A | 7/2001 |
| JP | 2002-285213 | A | 10/2002 |
| JP | 2003-239008 | A | 8/2003 |
| JP | 2004-156140 | A | 6/2004 |
| JP | 2010-229525 | A | 10/2010 |
| JP | 2011-256414 | A | 12/2011 |
| WO | 2010/032513 | A1 | 3/2010 |
| WO | 2014/065240 | A1 | 5/2014 |
| WO | 2014/080831 | A1 | 5/2014 |

OTHER PUBLICATIONS

International Search Report dated Dec. 15, 2015, issued for PCT/JP2015/076198.

International Search Report, issued in corresponding PCT Application No. PCT/JP2015/083784, dated Mar. 1, 2016.

Extended European Search Report issued in corresponding European Patent Application No. EP 15872381.7, dated Sep. 25, 2017.

Extended European Search Report issued in corresponding European Patent Application No. EP 15883358.2, dated Oct. 10, 2017.

Office Action issued in corresponding Chinese Patent Application No. CN 201580069669.9, dated Dec. 27, 2017.

Office Action issued in corresponding Chinese Patent Application No. CN 201580075742.3, dated Feb. 8, 2018.

Geology for Investors, "Nickel Laterites: The World's Largest Source of Nickel", published on or beofre Jun. 12, 2014.

Office Action issued in U.S. Appl. No. 15/552,031, dated Jun. 6, 2018.

Office Action issued in corresponding European Patent Application No. EP 15872381.7, dated Jun. 11, 2018.

* cited by examiner

METHOD FOR SMELTING NICKEL OXIDE ORE

TECHNICAL FIELD

The present invention relates to a method for smelting nickel oxide ore. More specifically, the present invention relates to a method for smelting nickel oxide ore including: forming a pellet from nickel oxide ore serving as a raw material ore; and smelting it by heat-reducing the pellet in a smelting furnace, thereby smelting the nickel oxide ore.

BACKGROUND ART

As methods for smelting nickel oxide ore which may also be called limonite or saprolite, known are a dry smelting method for producing nickel matte using a flash smelting furnace, a dry smelting method for producing an iron-nickel alloy (ferronickel) using a rotary kiln or moving hearth furnace, a wet smelting method for producing mixed sulfide using an autoclave and the like.

Dry smelting of nickel oxide ore commonly includes roasting the ore in a rotary kiln, and then melting the roasted ore in an electric furnace to obtain a ferronickel metal, and then separating slag. At this time, some iron is allowed to remain in the slag for maintaining the concentration of nickel in the ferronickel metal at a high level. However, it disadvantageously requires a large amount of electric energy because the whole amount of nickel oxide ore needs to be melted to generate slag and a ferronickel.

Patent Document 1 discloses a method including inputting nickel oxide ore and a reducing agent (anthracite) into a rotary kiln, and reducing the ore in a semi-molten state to reduce parts of nickel and iron into metal, and then recovering a ferronickel by gravity separation or magnetic separation. Advantageously, according to the above method, a ferronickel metal can be obtained without performing electric melting, leading to reduced energy consumption. However, the method suffers from the following problems: reduction is performed in a semi-molten state, and thus the produced metal will be dispersed in the form of small particles; and the yield of nickel metal will be relatively low partly due to losses during gravity separation and magnetic separation.

Further, Patent Document 2 discloses a method for producing a ferronickel using a moving hearth furnace. The method described in the above document includes mixing raw materials containing nickel oxide and iron oxide with a carbonaceous reducing agent to form a pellet, and heat-reducing the mixture in a moving hearth furnace to obtain a reduced mixture, and then melting the reduced mixture in a separate furnace to obtain a ferronickel. The document describes that alternatively, both slag and metal or one of either may be melted in a moving hearth furnace. However, melting the reduced mixture in a separate furnace requires a large amount of energy as in the melting process in an electric furnace. Further, disadvantageously, the slag and the metal may be fused to the furnace floor when melted in the furnace, resulting in difficult discharge from the furnace.

Furthermore, almost all of ferronickel recovered from nickel oxide ore, including limonite, saprolite, and the like, will serve as a raw material of stainless steel. Ferronickel with a high concentration of nickel is preferred for a raw material of stainless steel. Ferronickel with a nickel grade of 4% or more is usually sold at a price in accordance with the international standard price of LME. Disadvantageously, ferronickel with a nickel grade of less than 4%, on the other hand, may not be easily sold.

Patent Document 1: Japanese Examined Patent Application Publication No. H01-21855

Patent Document 2: Japanese Unexamined Patent Application, Publication No. 2004-156140

DISCLOSURE OF THE INVENTION

Problems to be Solved by the Invention

The present invention is proposed in view of the above actual circumstances. An object of the present invention is to provide a method for smelting nickel oxide ore, including forming a pellet from the nickel oxide ore, and heat-reducing the pellet in a smelting furnace to obtain an iron-nickel alloy (ferronickel), in which a high nickel grade of 4% or more can be achieved for the iron-nickel alloy by effectively promoting a smelting reaction in the smelting step (reduction step).

Means for Solving the Problems

The present inventors have conducted extensive studies to achieve the above object. After those extensive studies, the present inventors found that a reduction reaction can be effectively promoted to obtain an iron-nickel alloy with a high nickel grade by mixing nickel oxide ore serving as a raw material with a specific amount of a carbonaceous reducing agent to produce a pellet, and charging the pellet into a smelting furnace with the furnace floor covered with the carbonaceous reducing agent to perform reduction heat treatment. Then, the present invention was completed. That is, the present invention can provide the following.

(1) The present invention can provide a method for smelting nickel oxide ore, in which a pellet is formed from the nickel oxide ore, and the pellet is heat-reduced to obtain an iron-nickel alloy with a nickel grade of 4% or more, the method including:

a pellet production step of producing the pellet from the nickel oxide ore, and a reduction step of heat-reducing the resulting pellet in a smelting furnace, the pellet production step including mixing the nickel oxide ore with at least a carbonaceous reducing agent, the mixed amount of the carbonaceous reducing agent being adjusted so that the amount of carbon is 40% or less when the total combined value of a chemical equivalent required for reducing nickel oxide contained in the resulting pellet into nickel metal and a chemical equivalent required for reducing ferric oxide contained in said pellet into ferrous oxide and then further reducing a portion of the ferrous oxide into iron metal until the ratio of iron and nickel is 80:20 in an iron-nickel alloy to be obtained is taken as 100%, and agglomerating the resulting mixture to form a pellet, and the reduction step including pre-covering the furnace floor of the smelting furnace with a furnace floor carbonaceous reducing agent before charging the resulting pellet into the smelting furnace, and performing reduction heat treatment with the pellet loaded onto the furnace floor carbonaceous reducing agent.

(2) Further, the present invention can provide the method for smelting nickel oxide ore according to the above (1), in which the reduction step includes heat-reducing the pellet loaded onto the furnace floor carbonaceous reducing agent at a heating temperature of 1350° C. or more and 1550° C. or less.

(3) Further, the present invention can provide the method for smelting nickel oxide ore according to the above (1) or (2), in which the temperature when the pellet is charged into the smelting furnace is 600° C. or less.

Effects of the Invention

According to the present invention, an iron-nickel alloy with a high nickel grade of 4% or more can be obtained by effectively promoting a reduction reaction.

PREFERRED MODE FOR CARRYING OUT THE INVENTION

Below, specific embodiments of the present invention (hereafter referred to as the "present embodiments") will be described in detail with reference to the drawings. It is noted that the present invention shall not be limited to the following embodiments, and various modifications may be made without departing from the scope and the gist of the present invention.

<<Method for Smelting Nickel Oxide Ore>>

First, the method for smelting nickel oxide ore serving as a raw material ore will be described. Below, used as an example is a method for smelting, including pelletizing nickel oxide ore serving as a raw material ore, and reducing the resulting pellet to generate metal (an iron-nickel alloy (hereinafter, the iron-nickel alloy may be referred to as a "ferronickel")) and slag, and then separating the metal from the slag to produce the ferronickel.

Figure 1:
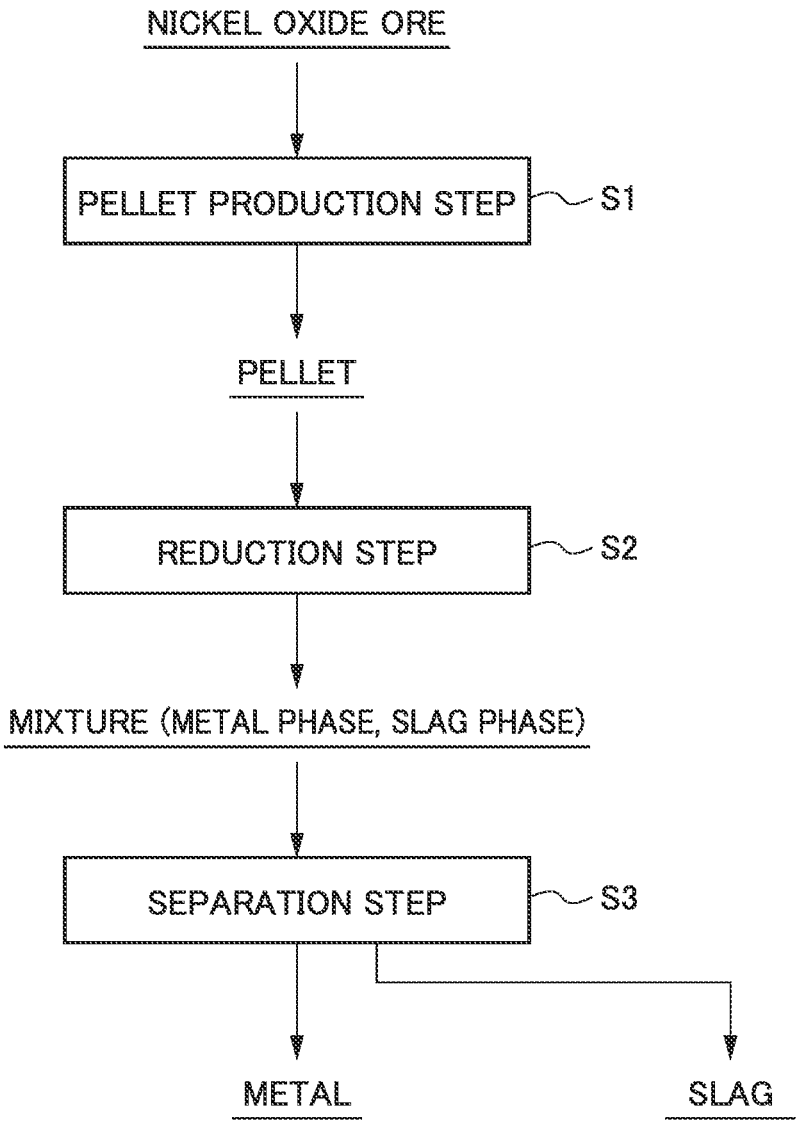
FIG. 1 is a process drawing showing the flow of a method for smelting nickel oxide ore.

The method for smelting nickel oxide ore according to the present embodiment includes preparing a pellet of the nickel oxide ore, and charging the pellet into a smelting furnace (reducing furnace), and performing heat reduction to obtain an iron-nickel alloy with a nickel grade of 4% or more. Specifically, as shown in the process chart of FIG. 1, the method for smelting nickel oxide ore according to the present embodiment includes a pellet production step S1 for producing a pellet from the nickel oxide ore, a reduction step S2 for heat-reducing the resulting pellet at a predetermined reduction temperature in a reducing furnace, and a separation step S3 of separating the metal and slag generated in the reduction step S2 to recover the metal.

<1. Pellet Production Step>

Figure 2:
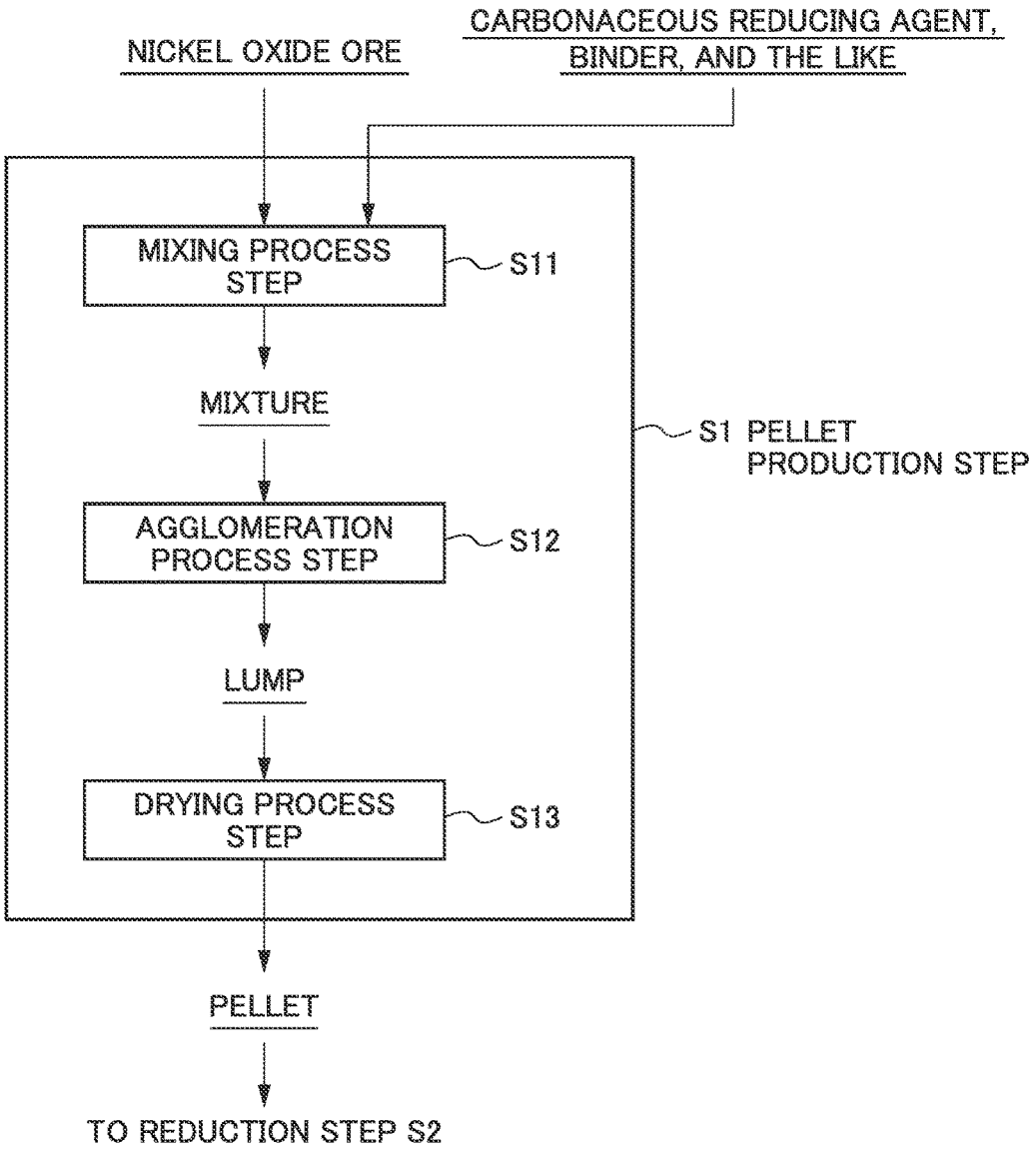
FIG. 2 is a process flowchart showing the flow of processes in the pellet production step of the method for smelting nickel oxide ore.

In the pellet production step S1, a pellet is produced from nickel oxide ore serving as a raw material ore. FIG. 2 is a process flowchart showing the flow of processing in the pellet production step S1. As shown in FIG. 2, the pellet production step S1 includes a mixing process step S11 of mixing raw materials containing a nickel oxide ore, an agglomeration process step S12 of forming (granulating) the resulting mixture into a lump, and a drying process step S13 of drying the resulting lump.

(1) Mixing Process Step

In the mixing process step S11, a raw material powder containing nickel oxide ore is mixed to obtain a mixture. Specifically, in the mixing process step S11, raw material powders of a flux component, a binder and the like are mixed in addition to a nickel oxide ore serving as a raw material ore to obtain a mixture, the raw material powders having a particle size, for example, on the order of 0.2 mm to 0.8 mm.

Here, when producing a pellet according to the present embodiment, a predetermined amount of a carbonaceous reducing agent is mixed to obtain a mixture, which is then used to form the pellet. There is no particular limitation for the carbonaceous reducing agent, but examples include coal powder, coke powder and the like. It is noted that the carbonaceous reducing agent preferably has a particle size similar to that of the nickel oxide ore as described above.

Here, the mixed amount of the carbonaceous reducing agent is adjusted so that the amount of carbon is 40% or less when the total combined value of a chemical equivalent (hereinafter may also referred to as a "chemical equivalent value" for convenience) required for reducing nickel oxide contained in the resulting pellet into nickel metal and a chemical equivalent (chemical equivalent value) required for reducing ferric oxide contained in said pellet into ferrous oxide and then further reducing a portion of the ferrous oxide into iron metal until the ratio of iron and nickel is 80:20 in an iron-nickel alloy to be obtained (which may be referred to as the "total value of the chemical equivalent values") is taken as 100%.

When a pellet is produced by mixing nickel ore with a mixed amount of a carbonaceous reducing agent in a predetermined proportion as described above, i.e., using a mixed amount of a carbonaceous reducing agent adjusted so that the amount of carbon is 40% or less relative to the aforementioned total value of the chemical equivalent values being 100%, trivalent iron oxide can effectively be reduced into divalent iron oxide, and nickel oxide can also be converted into metal, and the divalent iron oxide can be further reduced into metal to form a metal shell in the reduction heat treatment in the next reduction step S2 as further described below. In addition, partial reduction treatment can be performed in which some of the iron oxide contained in the shell is allowed to remain as oxide. This more effectively enables separate formation of a ferronickel metal (metal) with a high nickel grade and ferronickel slag (slag) inside one pellet.

It is noted that there is no particular limitation for the lower limit of the mixed amount of a carbonaceous reducing agent, but it is preferably adjusted so that the amount of carbon is in a proportion of 0.1% or more relative to the total value of the chemical equivalent values being 100% in view of a reaction rate.

There is no particular limitation for the nickel oxide ore, but limonite ore, saprolite ore and the like can be used. An iron component is contained in the nickel oxide ore.

Further, examples of the binder can include bentonite, polysaccharide, resin, water glass, dewatered cake and the like. Further, examples of the flux component can include calcium oxide, calcium hydroxide, calcium carbonate, silicon dioxide and the like.

Table 1 below shows an example of the composition (wt %) of a mixture obtained by mixing those raw material powders. However, the composition of the mixture of raw material powders is not limited to this.

TABLE 1

| | NiO | $Fe_2O_3$ | $SiO_2$ | CaO | MgO | $Al_2O_3$ |
|---|---|---|---|---|---|---|
| Dry ratio by weight of mixture of raw material powders [wt %] | 1.5 | 62.5 | 18.9 | 0.1 | 10.4 | 6.6 |

(2) Agglomeration Process Step

In the agglomeration process step S12, the mixture of raw material powders obtained in the mixing process step S11 is formed (granulated) into a lump. Specifically, an amount of water required for agglomeration is added to the mixture obtained in the mixing process step S11, and a pellet-like lump is formed with a lump production device (such as a rolling granulator, a compression molding machine, and an extrusion machine) or by hand.

There is no particular limitation for the shape of the pellet, but it may be, for example, spherical. Further, there is no particular limitation for the size of the lump to be formed into a pellet-like shape, but it may be, for example, on the order of 10 mm to 30 mm in terms of the size of a pellet (or the diameter in the case of a spherical pellet) to be charged into a smelting furnace in the reduction step after subjected to the drying process and the preheat treatment described below.

(3) Drying Process Step

In the drying process step S13, the lump obtained from the agglomeration process step S12 is subjected to a drying process. The lump formed into a pellet-like lump in the agglomeration process has an excess content of water as high as, for example, about 50 wt %, resulting in a sticky condition. In the drying process step S13, a drying process is performed so that the solid content of the lump is, for example, about 70 wt %, and the water content is about 30 wt % in order to facilitate the handling of the pellet-like lump.

There is no particular limitation for the drying process of a lump in the drying process step S13, but more specifically, hot air, at 300° C. to 400° C. for example, may be blown against the lump for drying. It is noted that the temperature of a lump when performing the drying process is less than 100° C.

An example of the composition (wt %) of the solid content of a pellet-like lump after the drying process is shown in Table 2 below. It is noted that the composition of a lump after the drying process shall not be limited to this.

TABLE 2

| | NiO | $Fe_2O_3$ | $SiO_2$ | CaO | MgO | $Al_2O_3$ | Binder | Others |
|---|---|---|---|---|---|---|---|---|
| Composition of solid content of dried pellet [wt %] | 0.8~1.5 | 30~70 | 10~25 | 0.1~10 | 4~12 | 4~9 | About 1 | Remainder |

In the pellet production step S1, a raw material powder containing nickel oxide ore serving as a raw material ore is mixed as described above, and the resulting mixture is granulated (agglomerated) into a pellet-like shape and dried to produce a pellet. At this time, a predetermined amount of a carbonaceous reducing agent is mixed according to the composition as described above when mixing raw material powders, and the resulting mixture is used to produce a pellet. The size of the resulting pellet is on the order of 10 mm to 30 mm. Pellets are to be produced which are strong enough to maintain the shapes thereof, such that, for example, the proportion of collapsed pellets is about 1% or less even after they are dropped from a height of 1m. Such pellets can withstand impacts of dropping and the like upon charging in the subsequent step of the reduction step S2, and can maintain their pellet-like shapes. Further, appropriate spaces will be formed between pellets. These can allow a smelting reaction in the smelting step to progress appropriately.

It is noted that a preheat treatment step may be included in this pellet production step S1, the preheat treatment step including preheating lumped pellets subjected to the drying process in the drying process step S13 described above to a predetermined temperature. Production of pellets via preheating a lump after the drying process as described above can reduce cracks (breaking, crumbling) in pellets induced by heat shock more effectively even when pellets are heat-reduced at a temperature as high as, for example, about 1400° C. in the reduction step S2. For example, the proportion of crumbled pellets relative to the total pellets charged into a smelting furnace can be reduced to a low level, and the pellet-like shape can be maintained more effectively.

Specifically, in the preheat treatment, pellets after the drying process are preheated at a temperature of 350° C. to 600° C. Further, the preheat treatment is preferably performed at a temperature of 400° C. to 550° C. Preheat treatment performed at a temperature of 350° C. to 600° C., or preferably at a temperature of 400° C. to 550° C. as described above, can reduce crystal water contained in nickel oxide ore of pellets. Therefore, collapsing of pellets due to the release of their crystal water can be reduced even when the temperature is rapidly increased by being charged into a smelting furnace at about 1400° C. Further, the preheat treatment performed as described above allows the thermal expansion of particles of nickel oxide ore, a carbonaceous reducing agent, a binder, a flux component and the like that compose the pellets to proceed slowly in two steps. This, in turn, can reduce collapsing of pellets due to differential expansion of particles. It is noted that there is no particular limitation for the processing time for the preheat treatment, and it can be appropriately adjusted depending on the size of the lump containing nickel oxide ore. It may be, however, on the order of 10 minutes to 60 minutes when a lump with a common size which results in obtained pellets having a size on the order of 10 mm to 30 mm is used.

<2. Reduction Step>

In the reduction step S2, the pellet obtained from the pellet production step S1 is heat-reduced at a predetermined reduction temperature. This reduction heat treatment of the pellet in the reduction step S2 promotes a smelting reaction (reduction reaction) to generate metal and slag.

Specifically, the reduction heat treatment in the reduction step S2 is performed in a smelting furnace (reducing furnace) and the like. A pellet containing nickel oxide ore is charged into the smelting furnace heated to a predetermined temperature for performing heat reduction. Specifically, the reduction heat treatment of a pellet is preferably performed at 1350° C. or more and 1550° C. or less. A heat reduction temperature of less than 1350° C. may not be able to effectively promote a reduction reaction. On the other hand, a heat reduction temperature of more than 1550° C. may excessively promote a reduction reaction, resulting in a decreased nickel grade.

There is no particular limitation for the temperature when a pellet is charged into a smelting furnace, but it is preferably 600° C. or less. Further, it is more preferably 550° C. or less in view that the possibility of burning a pellet due to a carbonaceous reducing agent can be more efficiently reduced.

When the temperature when a pellet is charged into a smelting furnace is more than 600° C., combustion of a carbonaceous reducing agent contained in a pellet may occur. On the other hand, there is no particular limitation for the lower limit, but it is preferably 500° C. or more because a much lower temperature may be disadvantageous in view of heating costs for a process where reduction heat treatment is continuously performed. It is noted that even if the temperature of a pellet upon charging is not controlled within the above temperature range, a pellet can be charged into a smelting furnace without causing any particular problems if charging is completed in a short time during which no impacts from burning and sintering occur.

Figure 3:
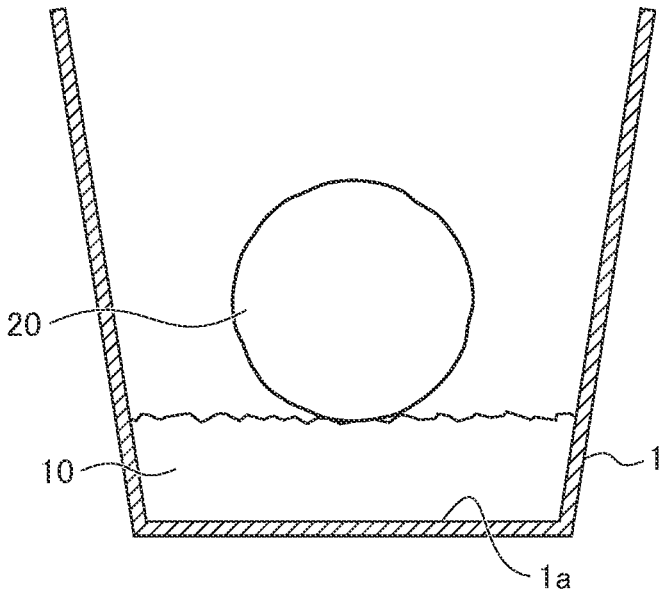
FIG. 3 schematically shows a state where a pellet is charged into a smelting furnace.

Now, in the present embodiment, for charging the resulting pellet in a smelting furnace, the furnace floor of said smelting furnace is pre-covered with a carbonaceous reducing agent (hereinafter referred to as the "furnace floor carbonaceous reducing agent"), and pellets are loaded onto said furnace floor carbonaceous reducing agent pre-covering the floor to perform reduction heat treatment. Specifically, as shown in the schematic view of FIG. 3, the furnace floor 1*a* of a smelting furnace 1 is pre-covered with a furnace floor carbonaceous reducing agent 10, for example, coal powder and the like, onto which a produced pellet 20 is loaded to perform the reduction heat treatment.

Here, FIGS. 4A to 4F schematically show the course of the reduction reaction in the pellet 20 when the reduction heat treatment is performed in the reduction step S2. First, in the present embodiment as described above, the furnace floor 1*a* of the smelting furnace 1 is pre-covered with the furnace floor carbonaceous reducing agent 10, and the pellet 20 is loaded onto that furnace floor carbonaceous reducing agent 10, and then the reduction heat treatment is started. It is noted that the reference number "15" is assigned to the carbonaceous reducing agent contained in the pellet 20.

In the reduction heat treatment, heat is conducted through the surface (surface layer portion) of the pellet 20 to promote a reduction reaction of iron oxide contained in a raw material ore as shown in the following reaction formula (i) (FIG. 4A), for example.

$$3Fe_2O_3+C \rightarrow 2Fe_3O_4+CO \quad \text{(i)}$$

When reduction at the surface layer portion 20*a* of the pellet 20 progresses to a reduction level of FeO ($Fe_3O_4$+C→3FeO+CO), replacement of nickel oxide (NiO) combined as NiO—$SiO_2$ with FeO is promoted to initiate reduction of Ni at the surface layer portion 20*a* as represented by the following reaction formula (ii) (FIG. 4B), for example. Subsequently, a reaction similar to the above reduction reaction of Ni is gradually promoted in the inside as heat is conducted from the outside.

$$NiO+CO \rightarrow Ni+CO_2 \quad \text{(ii)}$$

Figure 4A:
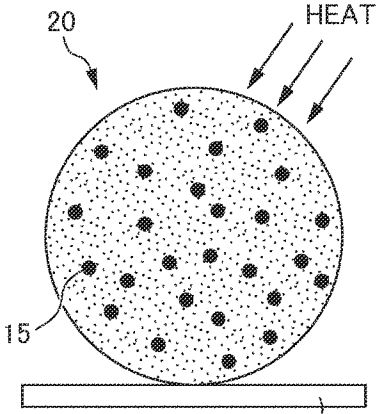
FIG. 4A-4F schematically show a course of the reduction heat treatment for the pellet.
Figure 4B:
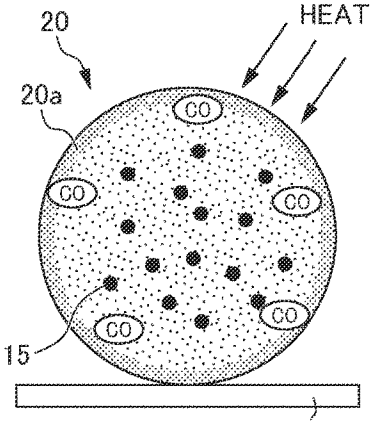
Figure 4C:
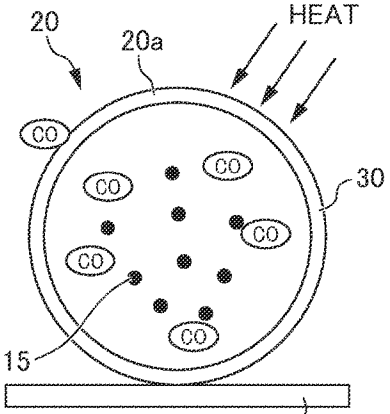

When the reduction reaction of iron oxide, for example, as shown in the following reaction formula (iii) progresses along with the reduction reaction of nickel oxide at the surface layer portion 20*a* of the pellet 20, a metal-forming process progresses at said surface layer portion 20*a* in a very short time such as about 1 minute to form an iron-nickel alloy (ferronickel), and then a shell of metal (metal shell) 30 is formed (FIG. 4C). It is noted that the shell 30 formed at this stage is thin, allowing $CO/CO_2$ gas to easily pass through it. Therefore, the reaction gradually proceeds toward the inside as heat is conducted from the outside.

$$FeO+CO \rightarrow Fe+CO_2 \quad \text{(iii)}$$

Figure 4D:
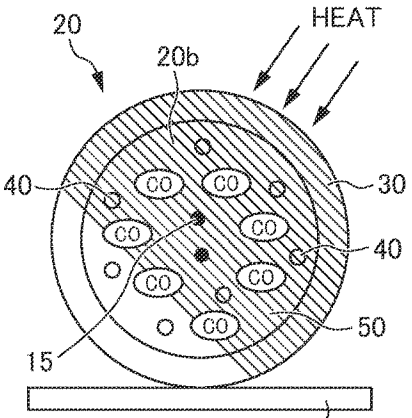

Then, as the metal shell 30 at the surface layer portion 20*a* of the pellet 20 gradually becomes thick due to the inwardly proceeding reaction, the inside 20*b* of the pellet 20 is gradually filled with CO gas. Then, the reducing atmosphere in the inside 20*b* increases to promote the metal-forming process of Ni and a portion of Fe, resulting in the formation of a metal particle 40 (FIG. 4D). Meanwhile, a slag component contained in the pellet 20 is gradually melted to generate slag 50 in the liquid phase (in a semi-molten state) in the inside (20*b*) of the metal shell 30.

Figure 4E:
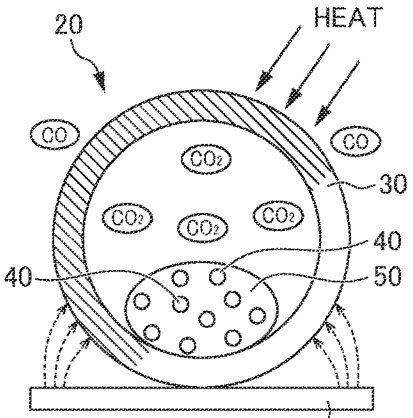

When all of the carbonaceous reducing agent 15 contained in the pellet 20 is consumed, the metal-forming process of Fe stops, and non-metallized Fe remains in the form of FeO (some are present as $Fe_3O_4$), and the slag 50 in a semi-molten state in the inside (20*b*) of the metal shell 30 will be totally melted (FIG. 4E). The slag 50 totally melted is in a state such that the metal particles 40 are dispersed therein.

Meanwhile, at this stage where the slag in a semi-molten state is totally melted, the carbon component remaining in the inside of the pellet without participating to the reaction and the excess portion of the carbon component in the furnace floor carbonaceous reducing agent 10 such as coal powder arranged to cover the furnace floor 1*a* of the smelting furnace 1, the excess portion not having been involved in the above reduction reaction, are incorporated into the metal shell 30 of an iron-nickel alloy (also referred to as "carburization" (shown by dotted-line arrows in FIG. 4E)), reducing the melting point of the iron-nickel alloy. As a result, the metal shell 30 of the iron-nickel alloy will be gradually melted.

Figure 5:
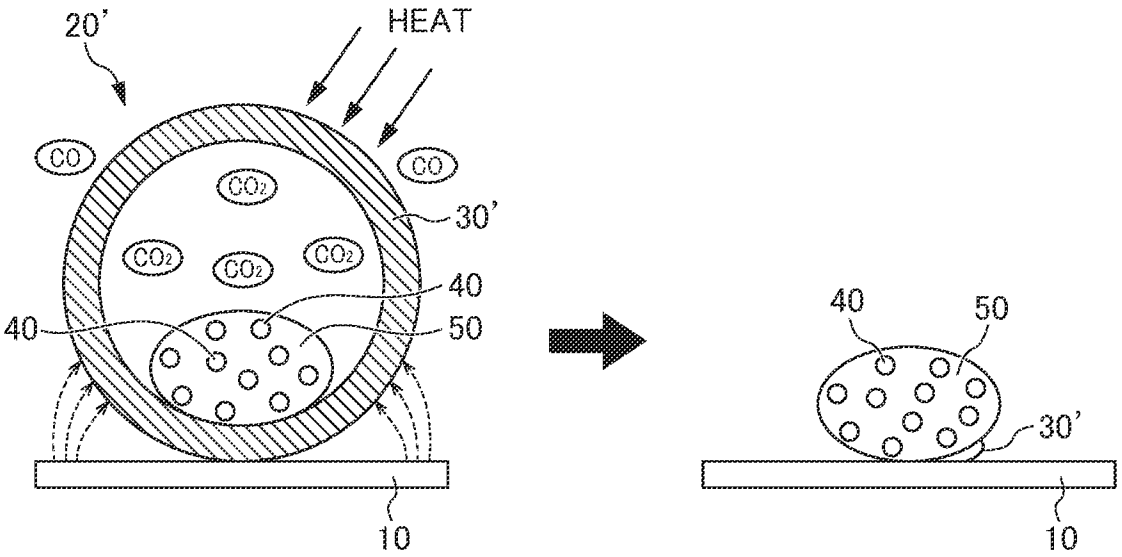
FIG. 5 schematically shows a course of total melting of a metal shell as carburization progresses.

At this time, when the carbonaceous reducing agent is contained in the pellet, for example, in a proportion of 100% or more relative to the aforementioned total value of the chemical equivalent values being 100%, a metal shell is completely melted (totally melted) due to carburization thereof. Specifically, FIG. 5 schematically shows how the metal shell is totally melted as carburization progresses after carburization against the metal shell is initiated. It is noted that in FIG. 5 for the sake of convenience, the pellet and the metal shell are designated as reference numbers of "20'''" and "30'''" respectively, and a process until the metal shell 30' is formed is omitted as it is similar to FIGS. 4A to 4D. When the content of the carbonaceous reducing agent in the pellet is large, for example, 100% or more relative to the total value of the chemical equivalent values being 100%, the metal shell 30' is totally melted as shown in FIG. 5 as reduction of iron oxide progresses. Then, this will result in a decreased nickel grade in the metal particles 40 dispersed in the slag 50.

Figure 4F:
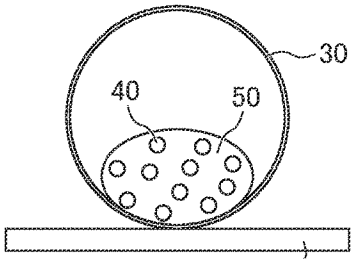

In contrast, according to the present embodiment, the mixed amount of the carbonaceous reducing agent 15 is adjusted to be a proportion of 40% or less relative to the aforementioned total value of the chemical equivalent values being 100%. When the amount of carbon contained in the inside of the pellet is 40% or less relative to the aforementioned total value of the chemical equivalent values, almost none of the carbonaceous reducing agent 15 remains in the inside of the pellet 20 at the stage shown in FIG. 4E. Consequently, the carburization of the metal shell 30 by the carbon component present in the inside of the pellet 20 is significantly slowed, thereby significantly reducing the rate of total melting of the metal shell 30. Here, melting of the metal shell 30 progresses slowly but steadily while the carbonaceous reducing agent 15 present in the inside of the pellet 20 becomes depleted. Therefore, the pellet will be finally discharged to the outside of the furnace while the metal shell 30 with a very thin thickness remains intact to keep its pellet-like form (FIG. 4F).

According to the present embodiment, the pellet is discharged to the outside of the furnace while the thin metal shell 30 remains intact as described above, and the metal particles 40 are recovered in a state where they are dispersed over the slag 50 in the inside of the pellet with the thin metal shell 30 which remains intact. It is noted that the metal shell 30 is very thin and thus fragile, allowing crushing treatment to be easily performed. After the crushing treatment, the slag 50 can be separated and removed by magnetic separation treatment and the like to obtain an iron-nickel alloy with a high nickel grade.

Now, according to the present embodiment as described above, the furnace floor 1*a* of the smelting furnace 1 is covered with the furnace floor carbonaceous reducing agent 10, onto which the pellet 20 is loaded to perform reduction heat-treatment. If the reduction heat treatment, however, is performed without covering the floor with the furnace floor carbonaceous reducing agent 10, incorporation (carburization) of the carbon component into the metal shell would not occur, and thus the metal shell would not be melted. As a result, the process would be ended while the metal shell remains in a thick spherical form. If that is the case, the thick metal shell can not be efficiently crushed at the subsequent crushing treatment, and the metal alone can not be effectively isolated even when magnetic separation treatment and the like are performed, resulting in a significantly reduced recovery rate of nickel.

There is no particular limitation for the amount of the furnace floor carbonaceous reducing agent 10 arranged to cover the furnace floor of a smelting furnace, but it may be an amount suitable for establishing a reducing atmosphere under which the metal shell 30 can be melted appropriately. Specifically, the amount may be, for example, such that it is suitable for establishing a reducing atmosphere under which the metal shell 30 formed during the course of reduction heat treatment can be melted when the content of the carbonaceous reducing agent 15 in the pellet 20 is 100% or more relative to the total value of the chemical equivalent values being 100%.

Here, when the metal shell is totally melted and maintained in the liquid phase for a long time in the smelting furnace 1 as shown in FIG. 5, for example, reduction of iron oxide may be promoted which remains unreduced by the furnace floor carbonaceous reducing agent 10 arranged to cover the furnace floor 1*a* thereof, resulting in a decreased nickel grade. Therefore, the metal and the slag have needed to be promptly removed from the furnace and further cooled to control the reduction reaction. In contrast, according to the present embodiment, the amount of the carbonaceous reducing agent 15 in the pellet 20 is adjusted to a predetermined proportion to allow a thin metal shell 30 remains after the reduction heat treatment. This can prevent a decrease in the nickel grade by virtue of the barrier effect of the remaining metal shell 30 even when it is retained inside the smelting furnace 1 for relatively long time. As described above, the method of smelting nickel oxide ore according to the present embodiment can further improve workability, and can efficiently provide an iron-nickel alloy with a high nickel grade.

Further, the composition of nickel oxide ore used as a raw material may vary depending on the type and origin of that ore. Therefore, the time to remove it from a furnace and the time for cooling are required to be adjusted for every ore to be used. In contrast, the reduction rate of iron oxide present in the inside of the shell 30 can be slowed by means of the furnace floor carbonaceous reducing agent 10 when treated so that the metal shell 30 remains in a way as in the present embodiment. This can effectively prevent a decrease in the nickel grade.

It is noted that as a guide in the present embodiment, the time between the charging of a pellet to start the reduction heat treatment and the removal of the pellet from the smelting furnace is preferably within, for example, approximately 60 minutes. Further, the pellet is preferably cooled so that the temperature becomes, for example, 500° C. or less after removing the pellet from the furnace to prevent rapid progress of reduction.

In the present embodiment as described above, trivalent iron oxide can be reduced into divalent iron oxide by the predetermined amount of the carbonaceous reducing agent 15 mixed in the pellet 20, and nickel oxide can also be converted into metal, and divalent iron oxide can be further reduced into metal to form the metal shell 30 and the metal particles 40. In addition, the reduction heat treatment is performed with the furnace floor of a smelting furnace covered with the furnace floor carbonaceous reducing agent 10, and thus the carbon component in the excess portion of the furnace floor carbonaceous reducing agent 10 not involved in the aforementioned reduction reaction in the furnace floor carbonaceous reducing agent arranged to cover the floor is incorporated into an iron-nickel alloy constituting the metal shell 30 as the reduction treatment progresses, resulting in moderate carburization and allowing a portion of the iron-nickel alloy to be melted and dispersed into the slag.

In particular, the amount of a carbonaceous reducing agent to be mixed in a pellet is adjusted to a predetermined proportion, i.e., adjusted so that the amount of carbon is 40% or less relative to the aforementioned total value of the chemical equivalent values being 100%, and then mixed with other raw materials to produce a pellet. Then the reduction heat treatment is performed on the resulting pellet to perform a so-called partial reduction, i.e., to allow the total of the iron oxide in the resulting metal shell 30 to be non-reduced during the reduction reaction thereof and allow a portion of the iron to remain as iron oxide so that thin and fragile metal shell 30 remains therein.

These enable enrichment of nickel, and also enable separate production of a ferronickel metal with an even higher nickel grade as well as ferronickel slag in the inside of one pellet. Specifically, an iron-nickel alloy (ferronickel) in which the nickel grade is higher than the proportion of nickel and iron in nickel oxide ore by 1.5 times or more, i.e., an iron-nickel alloy having a high nickel grade of 4% or more can be manufactured.

It is noted that the metal and the slag separately produced will not be mixed together even though the slag in a pellet is melted and present in the liquid phase, but will form a mixture where the metal solid phase and the slag solid phase coexist as separate phases after subsequent cooling. The volume of this mixture is reduced to a volume on the order of 50% to 60% as compared with that of the charged pellet.

<3. Separation Step>

In the separation step S3, the metal and the slag produced in the reduction step S2 are separated to recover the metal. Specifically, the metal phase is separated and recovered from a mixture containing the metal phase (the metal solid phase) and the slag phase (the slag solid phase containing a carbonaceous reducing agent) inside the thin metal shell 30 obtained from the reduction heat treatment of a pellet.

As a method for separating the metal phase and the slag phase from the mixture of the metal phase and the slag phase obtained as a solid, for example, the gravity separation method, the magnetic separation method and the like can used in addition to a method for removing large-sized particulate metal by sieving after cracking or grinding. That is, the thin metal shell 30 is first crushed to crush a mixture of the metal and slag phases inside the metal shell, and sieving is performed followed by magnetic separation and the like. The resulting metal and slag phases have poor wettability, allowing them to be separated easily.

The metal and slag phases are separated as described above to recover the metal phase.

EXAMPLES

Below, the present invention will be described in a more specific way with reference to Examples and Comparative Examples, but the present invention shall not be limited to the following Examples in any sense.

Example 1

Nickel oxide ore serving as a raw material ore, a binder, and a carbonaceous reducing agent were mixed to obtain a mixture. The mixed amount of the carbonaceous reducing agent included in the mixture was such that the amount of carbon was 20% relative to the total combined value of a chemical equivalent (chemical equivalent value) required for reducing nickel oxide contained in the resulting pellet into nickel metal and a chemical equivalent (chemical equivalent value) required for reducing ferric oxide contained in said pellet into ferrous oxide and then further reducing a portion of the ferrous oxide into iron metal until the ratio of iron and nickel is 80:20 in an iron-nickel alloy to be obtained was taken as 100%.

Next, an appropriate amount of water was added to the resulting mixture of the raw material powders, and kneading was performed by hand to form a spherical lump. Then, drying treatment was performed in which hot air at 300° C. to 400° C. was blown against the lump until the solid content of the resulting lump became about 70 wt %, and the water content became about 30 wt % to produce a spherical pellet (size (diameter): 17 mm). The composition of the solid content of the pellet after the drying treatment is shown in Table 3 below.

TABLE 3

| | $Fe_2O_3$ | NiO | $SiO_2$ | CaO | $Al_2O_3$ | MgO |
|---|---|---|---|---|---|---|
| Composition of solid content of dried pellet [wt %] | 33 | 0.8 | 17 | 12 | 3.5 | 5.5 |

Next, the furnace floor of a smelting furnace was covered with a coal powder (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace at a temperature condition of 600° C. or less.

Then, reduction heat treatment was performed in the smelting furnace at a reduction temperature of 1400° C. Subsequently, the pellets were removed from the furnace 15 minutes after the start of the reduction heat treatment.

An iron-nickel alloy (ferronickel metal) and slag were obtained from the reduction heat treatment as described above. The nickel and iron grades of the resulting ferronickel metal are shown in Table 4 below. The nickel grade of the iron-nickel alloy was 5.0%, which corresponded to about 1.8 times of a nickel grade of 2.8% where nickel and iron in the nickel ore are assumed to be all converted into metal.

TABLE 4

| | Grade [%] | |
|---|---|---|
| | Ni | Fe |
| Metal | 5.0 | 92 |
| Slag | <0.1 | 41 |

Example 2

Raw materials were mixed as in Example 1 to obtain a mixture, and then dry pellets were produced. At this time, the mixed amount of the carbonaceous reducing agent as a raw material in Example 2 was such that the amount of carbon was 40% relative to the aforementioned total value of the chemical equivalent values being 100%.

Next, the furnace floor of a smelting furnace was covered with a coal powder (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace at a temperature condition of 600° C. or less.

Then, reduction heat treatment was performed in the smelting furnace at a reduction temperature of 1400° C. The pellets were then removed from the furnace 5 minutes after the start of the reduction heat treatment.

A ferronickel metal and slag were obtained from the reduction heat treatment as described above. The nickel and iron grades of the resulting ferronickel metal are shown in Table 5 below. The nickel grade of the iron-nickel alloy was 4.8%, which corresponded to about 1.7 times of a nickel grade of 2.8% where nickel and iron in the nickel ore were assumed to be all converted into metal.

TABLE 5

| | Grade [%] | |
|---|---|---|
| | Ni | Fe |
| Metal | 4.8 | 93 |
| Slag | <0.1 | 42 |

Example 3

Raw materials were mixed in a similar way as in Example 1 to obtain a mixture, and then dry pellets were produced. At this time, the mixed amount of the carbonaceous reducing agent as a raw material was such that the amount of carbon was 20% relative to the aforementioned total value of the chemical equivalent values being 100%.

Next, the furnace floor of a smelting furnace was covered with a coal power (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace under a temperature condition of 600° C. or less.

Then, reduction heat treatment was performed inside the smelting furnace at a reduction temperature of 1400° C. Subsequently, the pellets were removed from the furnace 30 minutes after the start of the reduction heat treatment.

A ferronickel metal and slag were obtained from the reduction heat treatment as described above. The nickel and iron grades of the resulting ferronickel metal are shown in Table 6 below. The nickel grade of the iron-nickel alloy was 4.7%, which corresponded to about 1.7 times of a nickel grade of 2.8% where nickel and iron in the nickel ore were assumed to be all converted into metal.

TABLE 6

| | Grade [%] | |
|---|---|---|
| | Ni | Fe |
| Metal | 4.7 | 92 |
| Slag | <0.1 | 39 |

Example 4

Raw materials were mixed in a similar way as in Example 1 to obtain a mixture, and then dry pellets were produced. At this time, the mixed amount of the carbonaceous reducing agent as a raw material in Example 4 was such that the amount of carbon was 0.1% relative to the aforementioned total value of the chemical equivalent values being 100%.

Next, the furnace floor of a smelting furnace was covered with a coal powder (carbon content: 85 wt %, particle size: 0.4 mm) which served as a carbonaceous reducing agent, and 100 produced pellets were then charged so as to be loaded onto the furnace floor carbonaceous reducing agent arranged to cover the furnace floor thereof. The pellets were charged into the smelting furnace at a temperature condition of 600° C. or less.

Then, reduction heat treatment was performed in the smelting furnace at a reduction temperature of 1400° C. The pellets were then removed from the furnace 30 minutes after the start of the reduction heat treatment.

A ferronickel metal and slag were obtained from the reduction heat treatment as described above. The nickel and iron grades of the resulting ferronickel metal are shown in Table 7 below. The nickel grade of the iron-nickel alloy was 5.5%, which corresponded to about 2.0 times of a nickel grade of 2.8% where nickel and iron in the nickel ore were assumed to be all converted into metal.

TABLE 7

| | Grade [%] | |
|---|---|---|
| | Ni | Fe |
| Metal | 5.5 | 90 |
| Slag | <0.1 | 43 |

Comparative Example 1

Raw materials were mixed in a similar way as in Example 1 to obtain a mixture, and then dry pellets were produced. At this time, the mixed amount of the carbonaceous reducing agent as a raw material in Comparative Example 1 was such that the amount of carbon was 50% relative to the aforementioned total value of the chemical equivalent values being 100%.

Next, the furnace floor of a smelting furnace was covered with a coal power (carbon content: 85 wt %, particle size: 0.4 mm) which served as a carbonaceous reducing agent, and 100 produced pellets were then charged so as to be loaded onto the furnace-floor carbonaceous reducing agent arranged to cover the furnace floor thereof. The pellets were charged into the smelting furnace at a temperature condition of 600° C. or less.

Then, reduction heat treatment was performed inside the smelting furnace at a reducing temperature of 1400° C. The pellets were removed from the furnace 10 minutes after the start of the reduction heat treatment.

A ferronickel metal and slag were obtained from the reduction heat treatment as described above. The nickel and iron grades of the resulting ferronickel metal are shown in Table 8 below. As clearly seen from the result shown in Table 8, the nickel grade of the resulting iron-nickel alloy was 3.7%, which corresponded to only about 1.3 times of a nickel grade of 2.8% where nickel and iron in the nickel ore were assumed to be all converted into metal. That is, nickel was not sufficiently enriched in the ferronickel metal, and metal with a high nickel grade was not able to be obtained.

TABLE 8

| | Grade [%] | |
|---|---|---|
| | Ni | Fe |
| Metal | 3.7 | 93 |
| Slag | 0.2 | 42 |

EXPLANATION OF REFERENCE NUMERALS

10 Furnace floor carbonaceous reducing agent (arranged to cover furnace floor)
15 Carbonaceous reducing agent
20 Pellet
30 Metal shell (Shell)
40 Metal particle
50 Slag

The invention claimed is:

1. A method for smelting nickel oxide ore, in which a pellet is formed from the nickel oxide ore, and the pellet is heat-reduced to obtain an iron-nickel alloy with a nickel grade of 4% or more, the method comprising:

a pellet production step for producing a pellet from the nickel oxide ore, and a reduction step for heat-reducing the resulting pellet in a smelting furnace, the pellet production step comprising mixing the nickel oxide ore with at least a carbonaceous reducing agent, the mixed amount of the carbonaceous reducing agent being adjusted so that the amount of carbon is 0.1% or more and 40% or less when the total combined value of a chemical equivalent required for reducing nickel oxide contained in the resulting pellet into nickel metal and a chemical equivalent required for reducing ferric oxide contained in said pellet into ferrous oxide and then further reducing a portion of the ferrous oxide into iron metal until the mass ratio of iron and nickel is 80:20 in an iron-nickel alloy to be obtained is taken as 100%, and agglomerating the resulting mixture to form a pellet, and the reduction step comprising pre-covering the furnace floor of the smelting furnace with a furnace floor carbonaceous reducing agent before charging the resulting pellet into the smelting furnace, performing reduction heat treatment with the pellet loaded onto the furnace floor carbonaceous reducing agent, an amount of the furnace floor carbonaceous reducing agent being suitable for establishing a reducing atmosphere under which a metal shell forms on the pellet during reduction heat treatment and melts at a rate such that it remains intact during discharge of a heat-reduced pellet to the outside of the furnace, and heat-reducing the pellet loaded onto the furnace floor carbonaceous reducing agent at a heating temperature of 1350° C. or more and 1550° C. or less.

2. The method for smelting nickel oxide ore according to claim 1, wherein the temperature when the pellet is charged into the smelting furnace is 600° C. or less.

* * * * *